US005217774A

United States Patent [19]

Finrow

[11] Patent Number: 5,217,774

[45] Date of Patent: Jun. 8, 1993

[54] GAME BOX PROTECTOR AND REPAIR DEVICE

[76] Inventor: Thomas M. Finrow, 8265 Commercial St., #12, La Mesa, Calif. 91942

[21] Appl. No.: 714,512

[22] Filed: Jun. 13, 1991

[51] Int. Cl.[5] ..... B32B 7/06; B32B 7/12; B32B 3/08

[52] U.S. Cl. ..... 428/40; 428/77; 428/80; 229/199

[58] Field of Search ..... 428/40, 80, 77; 229/199

[56] References Cited

U.S. PATENT DOCUMENTS

| | | | |
|---|---|---|---|
| 355,252 | 12/1886 | Bradley | 229/199 |
| 2,098,909 | 11/1937 | Angier | 229/199 |
| 2,283,349 | 5/1942 | Angier | 229/199 |
| 3,107,673 | 10/1963 | Haddad | 402/79 |

*Primary Examiner*—Alexander S. Thomas
*Attorney, Agent, or Firm*—Charles C. Logan, II

[57] ABSTRACT

The game box protector and repair device is used to reinforce the corners of paper and plastic boxes such as those used by toy manufacturers. It has two parts, a flexible sheet of filament impregnated tape having an adhesive coating on its bottom surface and a flexible sheet of backing release paper that is lightly adhered to the bottom surface of the sheet of filament impregnated tape. The sheet of filament impregnated tape has a substantially rectangular main body portion having a left finger tab and a right finger tab that are laterally spaced from each other a predetermined distance and which extend from the top edge of the main body portion. When applied to the game box, the main body portion is adhered to the outside surface of the walls forming the corner and the finger tabs are folded over the top edge of the side walls so that they adhere to the inside surface of the walls forming the corner.

3 Claims, 1 Drawing Sheet

GAME BOX PROTECTOR AND REPAIR DEVICE

BACKGROUND OF THE INVENTION

The invention relates to game and toy boxes and more specifically to a device for repairing the broken corners of these boxes.

A consistent problem that has existed in almost every household is the fact that game boxes and toy boxes often have their corners broken which allows the pieces to be lost or misplaced. Also the broken corners often result in the pieces or other items in the box being crushed due to the lack of structural strength in the box to support other boxes on its top surface. Once the corners become broken, it is not long before the edges become broken. Small children are often the culprits in destroying the game boxes by stepping on them causing the corners to split.

It is an object of the invention to provide a novel game box protector and repair device that can be used to restore damaged game or toy boxes.

It is also an object of the invention to provide a novel game box protector and repair device that can be installed in seconds.

It is another object of the invention to provide a novel game box protector and repair device that produces game box corners that are stronger once repaired than they were when purchased.

It is a further object of the invention to provide a novel game box protector and repair device that is economical to manufacture and market.

SUMMARY OF THE INVENTION

The game box protector and repair device is used to reinforce the corners of paper and plastic boxes such as those used by toy and game manufacturers such as "Monopoly", "Clue", "Sorry", "Stratego", etc. Most families have bought numerous of boxed games and have had the corners and other edges stepped on by children causing the corners and other edges to break. The novel game box protector and repair device is designed to repair these game boxes and give them structural integrity.

The invention is formed of two sheets of material. One is a flexible sheet of filament impregnated tape having an adhesive coating on its bottom surface. The second flexible sheet is made of backing release paper having a top surface that is lightly adhered to the bottom surface of the sheet of filament impregnated tape; which allows it to be easily removed when the filament impregnated tape is to be applied to the corners of a game box.

The sheet of filament impregnated tape has a substantially rectangular main body portion having laterally spaced right and left finger tabs extending a predetermined distance from its top edge. The finger tabs are laterally spaced from each other a predetermined distance and they have a predetermined width. When the sheet of filament impregnated tape is applied to the damaged game box, the main body portion is adhered to the outside surface of the adjacent side walls forming the corner. The left and right finger tabs are then folded over the top edges of the side walls of the box and pressed into engagement with the respective inside surfaces of the side walls that form the corner. The filament impregnated tape thus connects the separated wall sections of the game box and due to its own inherent superior strength gives structural integrity to the repaired corner.

The game box protector and repair device will be preferrably sold in packages containing a predetermined number of the devices. They may be all one size or they may have varied sizes to be used with different sized game boxes. The novel game box protector and repair devices can even be installed before the game box has been damaged thereby making it a stronger box than originally purchased.

DESCRIPTION OF THE PREFERRED EMBODIMENT

Figure 1:
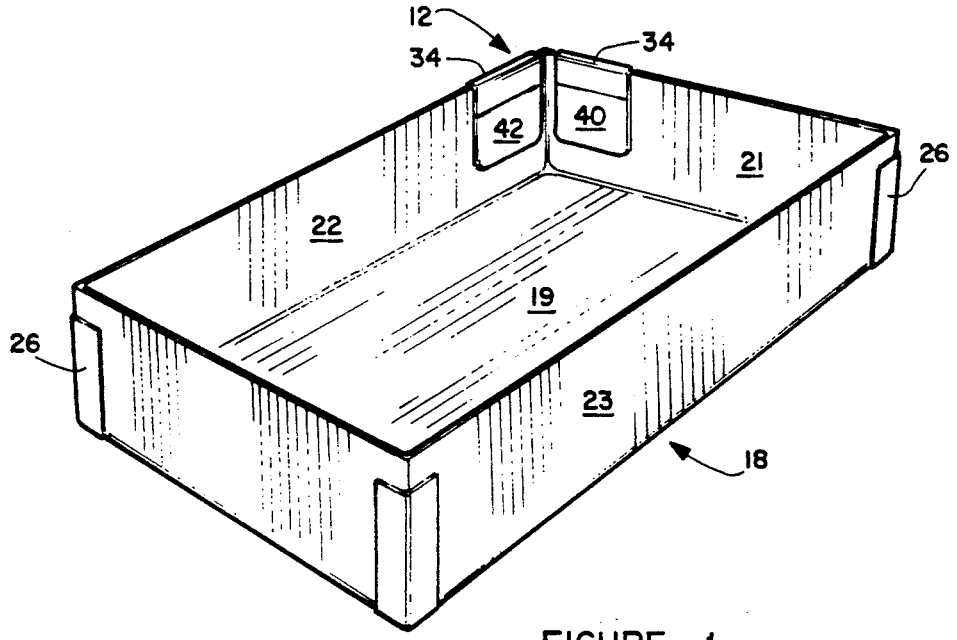
FIG. 1 is a front perspective view showing the bottom half of a game box with one of the novel game box protector and repair devices installed.
Figure 2:
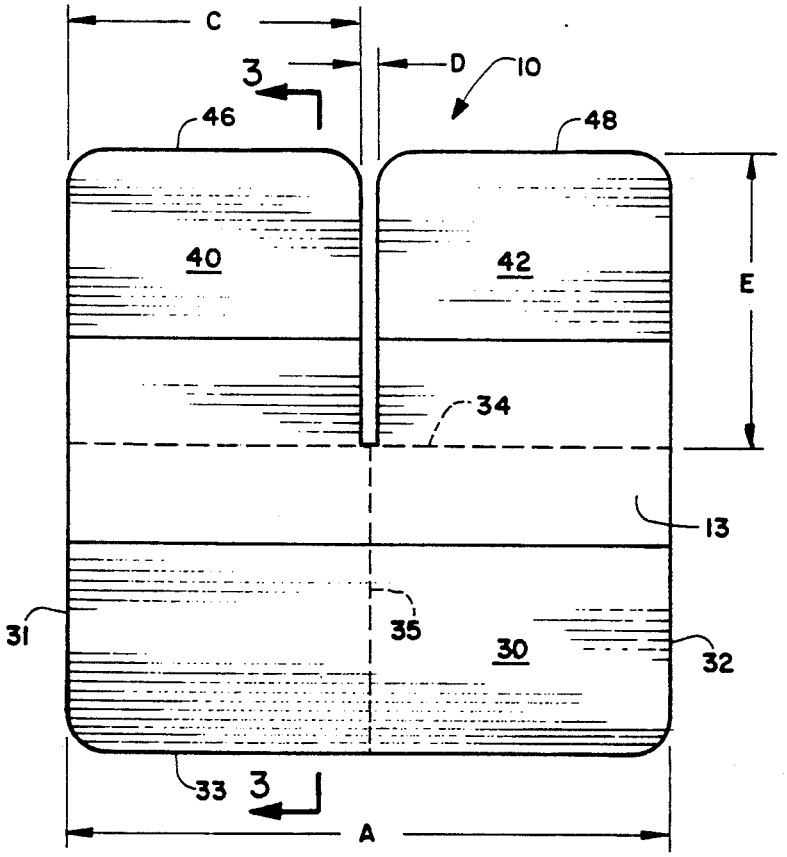
FIG. 2 is a front elevation view of one of the game box protector and repair devices.
Figure 3:
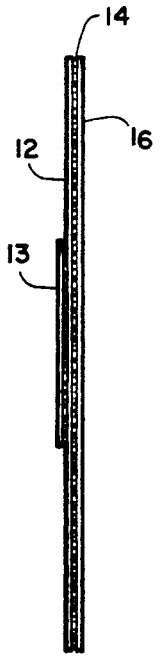
FIG. 3 is an enlarged cross sectional view taken along lines 3—3 of FIG. 2.

The game box protector and repair device will now be described by referring to FIGS. 1-3 of the drawing. The game box protector and repair device is generally designated numeral 10. It is formed from a flexible sheet of filament impregnated tape 12 having an adhesive coating 14 on its rear surface and a flexible sheet of backing release paper 16.

The bottom half of a box 18 has a bottom wall 19, end walls 20 and 21, and side walls 22 and 23. Strips of existing tape 26 show the structure which is generally used on the boxes to hold the corners together in their original as purchased state. Filament impregnated tape sheet 12 is shown installed on one of the corners of the box.

The sheet 12 of filament impregnated tape has a rectangularly shaped main body portion 30 having a left edge 31, a right edge 32, a bottom edge 33 and a top edge 34 that is the intended fold surface when the sheet is installed. A second intended fold line 35 divides main body portion 30 substantially in half. A left finger tab 40 and a right finger tab 42 extend upwardly from top edge 34 and they in turn have their own top edges 46 and 48. The height of the finger tabs is the dimension B and they are laterally spaced from each other a predetermined distance D. The finger tabs have a width C and main body portion 30 has a width A. An extra layer 13 of filament impregnated tape is applied to the top surface of sheet 12 to reinforce the area between the finger tabs where top edge 34 passes.

What is claimed is:

1. A game box protector and repair device comprising:

a flexible primary sheet of filament impregnated tape having a predetermined two dimensional shape, said primary sheet having a top surface, and a bottom surface having an adhesive coating thereon;

said primary sheet of filament impregnated tape having a substantially rectangular main body portion having a top edge, laterally spaced left and right side edges and a bottom edge, a left finger tab and a right finger tab extend from the top edge of said main bottom portion a predetermined distance E and they are laterally spaced from each other to form an open space between them having a predetermined width D and they each have a predetermined width C;

an extra layer of filament impregnated tape being in the form of a strip that extends from the left edge of said primary sheet to its right edge, said extra layer of filament impregnated tape overlapping said main bottom portion and said left and right finger tabs, said extra layer of filament impregnated tape having an open space between said left and right finger tabs where it overlaps them and said extra layer of filament impregnated tape functions to reinforce the area between said finger tabs where the top edge of said main body portion passes; and a flexible sheet of backing release paper having a top surface that is lightly adhered to the bottom surface of said sheet of filament impregnated tape.

2. A game box protector and repair device as recited in claim 1 wherein said flexible sheet of filament impregnated tape has a substantially four sided shape having four corners.

3. A game box protector and repair device as recited in claim 2 wherein the four corners of said flexible sheet of filament impregnated tape are rounded.

* * * * *